US012053815B2

(12) United States Patent
Denks et al.

(10) Patent No.: US 12,053,815 B2
(45) Date of Patent: Aug. 6, 2024

(54) METHOD FOR THE PRODUCTION OF CHASSIS PARTS FROM MICRO-ALLOYED STEEL WITH IMPROVED COLD FORMABILITY

(71) Applicant: Salzgitter Flachstahl GmbH, Salzgitter (DE)

(72) Inventors: Ingwer Denks, Wolfenbüttel (DE); Stefan Mütze, Peine (DE); Christian Pelz, Wolfenbüttel (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 325 days.

(21) Appl. No.: 16/349,883

(22) PCT Filed: Nov. 15, 2017

(86) PCT No.: PCT/DE2017/100969
§ 371 (c)(1),
(2) Date: May 14, 2019

(87) PCT Pub. No.: WO2018/091038
PCT Pub. Date: May 24, 2018

(65) Prior Publication Data

US 2020/0078853 A1 Mar. 12, 2020

(30) Foreign Application Priority Data

Nov. 15, 2016 (DE) ..... 10 2016 121 902.9

(51) Int. Cl.

| | |
|---|---|
| ***B21D 53/88*** | (2006.01) |
| ***C21D 8/02*** | (2006.01) |
| ***C21D 9/00*** | (2006.01) |
| ***C22C 38/04*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/20*** | (2006.01) |
| ***C22C 38/40*** | (2006.01) |
| ***C22C 38/42*** | (2006.01) |
| ***C22C 38/48*** | (2006.01) |
| ***C22C 38/50*** | (2006.01) |
| ***C22C 38/58*** | (2006.01) |

(52) U.S. Cl.
CPC ..... *B21D 53/88* (2013.01); *C21D 8/0205* (2013.01); *C21D 8/0226* (2013.01); *C21D 9/0068* (2013.01); *C22C 38/04* (2013.01); *C22C 38/12* (2013.01); *C22C 38/14* (2013.01); *C22C 38/16* (2013.01); *C22C 38/18* (2013.01); *C22C 38/20* (2013.01); *C22C 38/40* (2013.01); *C22C 38/42* (2013.01); *C22C 38/48* (2013.01); *C22C 38/50* (2013.01); *C22C 38/58* (2013.01); *C21D 2221/00* (2013.01)

(58) Field of Classification Search
CPC ..... B21D 53/88; B21D 22/04; C21D 8/0205; C21D 8/0226; C21D 9/0068; C21D 2221/00; C21D 1/26; C21D 8/04; C21D 8/02–0494; C21D 8/0294; C22C 38/42; C22C 38/48; C22C 38/50; C22C 38/04; C22C 38/16; C22C 38/18; C22C 38/20; C22C 38/40; C22C 38/58; C22C 38/12; C22C 38/14
See application file for complete search history.

(56) References Cited

U.S. PATENT DOCUMENTS

| | | | | |
|---|---|---|---|---|
| 3,028,468 | A * | 4/1962 | Holman | B21D 25/00 219/602 |
| 5,122,198 | A * | 6/1992 | von Hagen | C21D 9/08 148/651 |
| 2002/0005622 | A1* | 1/2002 | Glaser | B60B 35/006 280/124.166 |
| 2009/0235715 | A1* | 9/2009 | Werz | B21D 53/20 72/342.1 |
| 2009/0314394 | A1* | 12/2009 | Taulavuori | C21D 8/0205 148/610 |
| 2010/0239452 | A1* | 9/2010 | Arvedi | C22C 38/12 420/91 |
| 2013/0105046 | A1* | 5/2013 | Carlson | C21D 9/0068 228/176 |
| 2013/0125607 | A1* | 5/2013 | Samek | C21D 9/0068 72/364 |
| 2016/0160330 | A1* | 6/2016 | Zhong | C21D 9/46 428/544 |
| 2016/0222484 | A1* | 8/2016 | Koyer | C21D 6/005 |
| 2016/0303635 | A1* | 10/2016 | Branagan | C22C 38/42 |
| 2020/0038933 | A1* | 2/2020 | Mutze | C21D 8/0278 |

FOREIGN PATENT DOCUMENTS

| | | |
|---|---|---|
| DE | 102008060161 | 6/2010 |
| DE | 102009049155 | 4/2011 |

(Continued)

OTHER PUBLICATIONS

International Search Report issued by the European Patent Office in International Application PCT/DE2017/100969 on Feb. 15, 2018.

*Primary Examiner* — Adil A. Siddiqui
(74) *Attorney, Agent, or Firm* — Henry M. Feiereisen LLC

(57) ABSTRACT

The invention relates to a method for producing a chassis part from micro-alloyed steel, having an improved cold workability of cold-solidified, mechanically separated sheet-metal edges, comprising the following method steps: —providing a hot-rolled strip or a hot-rolled strip sheet of the claimed alloy composition in weight percent, cutting a blank at room temperature and optionally carrying out further punching or cutting operations, —heating exclusively the sheet metal edge regions of the blank, which have been cold-solidified by the cutting or punching operations, to a temperature of at least 700° C. with a dwell time of at most 10 seconds and subsequent cooling with air, —cold forming the blank in one or more steps to form a chassis part at room temperature.

19 Claims, No Drawings

(56) References Cited

FOREIGN PATENT DOCUMENTS

| | | | | |
|---|---|---|---|---|
| DE | 102011121904 | | 6/2013 | |
| DE | 102012002079 | | 8/2013 | |
| DE | 102013216317 | A1 * | 2/2015 | ..... B60N 2/64 |
| DE | 102014016614 | | 5/2016 | |

* cited by examiner

METHOD FOR THE PRODUCTION OF CHASSIS PARTS FROM MICRO-ALLOYED STEEL WITH IMPROVED COLD FORMABILITY

CROSS-REFERENCES TO RELATED APPLICATIONS

This application is the U.S. National Stage of International Application No. PCT/DE2017/100969, filed Nov. 15, 2017, which designated the United States and has been published as International Publication No. WO 2018/091038 and which claims the priority of German Patent Application, Serial No. 10 2016 121 902.9, filed Nov. 15, 2016, pursuant to 35 U.S.C. 119(a)-(d).

BACKGROUND OF THE INVENTION

The invention relates to a method for the production of chassis parts from micro-alloyed steel with improved cold formability, produced from cold formed plates, wherein the plates have improved cold formability of strain-hardened, mechanically separated edges. Chassis components may involve, for example, axle brackets, transverse control arms, multilink rear axles twist-beam axles, front axles, control arms as well as longitudinal and transverse cross members.

The production of chassis components by cold forming is known for example from laid-open document DE 10 2008 060 161 A1 Disclosed therein is a method for the production of a chassis component with increased fatigue strength. A material is used for cold forming and is made of (in weight-%): Carbon (C): 0.22% to 0.25%, Silicon (SI): 0.20% to 0.30%, Manganese (Mn): 1.20% to 1.40%, Phosphorus (P): maximal 0.020%, Sulphur (S): maximal 0.010%, Aluminum (Al): 0.020% to 0.060%, Boron (B): 0.0020% to 0.005%, Chromium (Cr): 0.10% to 0.20%, Titanium (Ti): 0.020% to 0.050%, Molybdenum (Mo): maximal 0.35%, Copper (Cu): maximal 0.10%, Nickel (Ni): maximal 0.30%, remainder iron and impurities resulting from smelting. To increase fatugue strength of the component, the semi-finished product is subjected to a nitriding treatment. Cold formability of strain-hardened, mechanically separated sheet-metal edges is not addressed.

The production of a chassis component normally involves a sheet-metal plate, predominantly from hot strip, which initially is cut to size at room temperature. Cutting processes mostly involve mechanical separation processes, like, e.g., laser cutting. Thermal separation processes are significantly more expensive compared to mechanical separation processes, so that their application represents the exception.

After cutting, the cut plate is placed in a forming tool and shaped to a finished chassis component by a single-stage or multi-stage forming steps.

Various further manufacturing steps, like, e.g., punching and cutting operations on the plate and the provision of holes for weight reduction or passageways for lines etc. are carried out before cold forming, and in some cases combined folding or expansion operations are performed on the holed portions during transformation.

During cold forming, the cutting edges, especially when being raised or folded up are under particular strain, e.g. during collaring in perforated plates.

The presence of various pre-existing damages may be encountered at the cutting edges. On one hand, resulting from strain hardening of the material, caused by the mechanical separation, representing a total transformation up to material separation. On the other hand, a notch effect may be encountered as caused by the topography of the cutting surface.

In particular, when high-strength and super high-strength sheet-metal materials are involved, increased likelihood of cracking in the edge regions of these cutting edges is therefore encountered in dependence on the actual alloy composition and the microstructure during subsequent transformation. The mentioned pre-existing damages at the sheet-metal edges may result in premature failure during following forming operations or during travel. Examination of the forming behavior of cut sheet-metal edges in terms of their edge cracking sensitivity is performed by a hole expanding test according to ISO 16630.

The hole expanding test involves the introduction of a circular hole into the sheet metal through shear cutting, which circular hole is then expanded by a conical die. The measuring variable involves the change in the hole diameter in relation to the initial diameter, when the first crack is encountered through the metal sheet at the edge of the hole.

In order to minimize the afore-described sensitivity to edge cracking during cold forming of sheared or punched sheet-metal edges, approaches are known, for example, for changing the ahoy composition and material processing (e.g. targeted adjusting of bainitic microstructures) or in terms of process during cold trimming of the plate (e.g. by modifying cutting gap, speed, multiple trim, etc.).

These measures are either expensive or complex (e.g. multi-stage cutting operations, maintaining 3-D cuts etc.), or yet fail to provide optimum results.

It is also known from laid-open document DE 10 2009 049 155 A1 to heat at least the region of the cutting edge to a defined temperature and to carry out cutting at this temperature so as to improve the forming capability of the cut edges and thereby reduce or avoid the strain-hardening in the region of the cutting edge. The downside here is the need for significant technical and economical operations for heating the metal sheet on one hand, and on the other hand the forced coupling of heating the plate and immediately thereafter cutting that renders the production more rigid.

It is moreover known from laid-open document DE 10 2011 121 904 A1 to cold form a sheared metal sheet and then to locally heat by a laser the strain-hardened regions before further forming operations, with the objective of a parallel softening. In particular disadvantageous is here the local softening which represents a discontinuity in relation to the use of oftentimes high-strength or super high-strength material, especially in stress situations and when subject to oscillating stress. Furthermore, it is unclear as to where precisely heating should take place and how the local heating should actually be realized with temperature and time profile. Further, it is unclear, how and to which extent the partial softening is able to improve the forming capability of the already cold-formed metal sheet.

Laid-open document DE 10 2014 016 614 A1 discloses a method for producing a cold-formed component from a sheet-metal plate sheared at room temperature with optionally various further production steps carried out at room temperature, such as e.g. hole punching or cutting operations, in which the sheet-metal regions that have strain-hardened during the cutting or punching operations and undergo a subsequent cold forming during the production of the component, are heated to a temperature of at least 600° C. and the time of the temperature application is less than 10 seconds. As a result, the cold formability of these strain-hardened sheet-metal edges should be significantly improved. This process finds application, i.e. in micro-alloyed steels. However, there are no indications of a concrete alloy composition of the steels disclosed there and the effect of the heat treatment on the resulting microstructure.

Current state of the art involves therefore the need for a complex reworking of the raised edges. Very high reject in the production at various processors is common. In addition, the realization of complex component geometries is not possible with the material known from German laid-open document DE 10 2008 060 161 A1, and thus the constructive freedom of design is limited.

Object of the present invention is to provide a method for the production of chassis components from micro-alloyed steel, produced from cold-formed plates, which have improved formability of strain-hardened, mechanically separated sheet-metal edges.

SUMMARY OF THE INVENTION

According to the teachings of the invention, this object is achieved by a method with comprising the following steps:

providing a hot strip or a hot strip metal sheet, having the following alloy composition in weight-%: C: 0.04 to 0.12, Si: max. 0.7, Mn: 1.4 to 2.2, P: max. 0.02, S: max. 0.002, N: max. 0.03, V: 0.005 to 0.5, Nb: 0.005 to 0.1, Ti: 0.005 to 0.2, (V+Nb+Ti: min. 0.05 max. 0.4), and one or more of the elements of the sum of Cu+Cr+Ni: max. 1 (at least 0.0) with Cr: max. 0.9, Ni: max. 0.5, Cu: max. 0.5, as well as optional Mo: max. 0.5, remainder iron and impurities resulting from smelting, cutting a plate at room temperature and optional execution of further punching or cutting operations, to achieve recesses, holes or openings on the plate at room temperature heating only the sheet-metal edge regions of the plate as strain-hardened by the cutting or punching operations to a temperature of at least 700° C. with a holding time of at most 10 seconds and subsequent cooling in air cold forming of the plate in one or more steps to a chassis component at room temperature.

providing a hot strip or a hot strip metal sheet, having the following alloy composition in weight-%: C: 0.04 to 0.12, Si: max. 0.7, Mn: 1.0 to 2.2, P: max. 0.02, S: max. 0.002, N: max. 0.03, V: 0.005 to 0.5, Nb: 0.005 to 0.1, Ti: 0.005 to 0.2, (V+Nb+Ti: min. 0.05 max, 0.4), and one or more of the elements of the sum of Cu+Cr+Ni: max. 1 (at least 0.0) with Cr: max. 0.9, Ni: max. 0.5, Cu: max. 0.5, as well as optional Mo: max. 0.5, remainder iron and impurities resulting from smelting, cutting a plate at room temperature and optional execution of further punching or cutting operations, to achieve recesses, holes or openings on the plate at room temperature heating only the sheet-metal edge regions of the plate as strain-hardened by the cutting or punching operations to a temperature of at least 700° C. with a holding time of at most 10 seconds and subsequent cooling in air cold forming of the plate in one or more steps to a chassis component at room temperature.

Due to the lower production costs, hot strip is preferred over cold strip in many applications.

The advantage of micro-alloyed hot strip according to the invention with the mentioned composition range is that in combination with the heat treatment according to the invention in the transition region to the base material, a particularly beneficial microstructure is formed. This transition region is also known as heat impact zone. Particularly noteworthy is the slight difference in hardness in the microstructural constituents to be expected and a comparatively low hardness decrease in the transition region compared to the base material. This region is particularly vulnerable to crack formation when collaring. The reason is the presence there of high stress during formation of the collar, and at the same time, in contrast to the edge and the base material, the microstructure tends to inhomogeneity and therefore has comparatively low resistance to crack proliferation. With respect to the inhomogeneity, in particular the formation of high hardness differences between the phase components in terms of crack resistance is unfavorable. In the case of micro-alloyed steels having the afore-mentioned composition, the differences in hardness between the phase constituents, in particular due to the addition of micro-alloying elements, are decreased and thus overall the edge crack resistance is enhanced.

The decrease in the hardness differences between the microstructural constituents is in particular due to the stated levels of micro-alloying elements (V, Nb, Ti). The effect of the mentioned microelements is hereby based in particular in that the hardness of the naturally comparatively soft ferrite increases considerably as a result of precipitation formation. The effect is known as precipitation hardening. Since the carbon-rich, hard microstructural constituents (bainite, martensite) which are also to be expected in the transition region do not increase in the hardness in the same way through precipitation formation, a homogeneity of the hardness differences is achieved.

An actual effect is to be expected only at a sum content of V+Nb+Ti: min. 0.05. Due to a certain saturation behavior and cost reasons, contents above V+Nb+Ti=0.4 are not sensible.

In the method according to the invention, it is heated at least to Ac1, preferably to above Ac3. Advantageously, a reduction of the duration of treatment can normally be realized by heating, for example, to 100° C. above Ac3.

A partial, preferably complete transformation takes hereby place in austenite, which converts through subsequent rapid cooling into martensite and/or bainite. The final microstructure in the edge region of the sheared edges thus usually consists of martensite and/or bainite as well as small proportions of tempered basic structure. The proportion of the tempered basic microstructure decreases with increasing edge distance, while the proportion of the original basic microstructure increases with increasing edge distance.

The edge region treated according to the invention differs from the sheared state, apart from the change in microstructure, in that strain hardening is eliminated. In sum, the newly formed microstructure without strain hardening is clearly preferable compared to the microstructure in the sheared state with strain hardening in terms of crack tolerance, even though the newly formed microstructure may have a slightly lower toughness.

Chassis components represent an application example in which high demands are placed on the formability of the flat component regions as well as on the sheared edges. An optimum in the formability of both regions can already mean a decisive advantage in the construction of new component geometries.

When forming flat component regions, the critical formability can be represented by means of the forming limit diagram. An optimum is achieved when the forming limit curve reaches a highest possible level. The susceptibility to cracking of sheared edges, however, is not reflected by the location of the forming limit curve. Empirical evidence shows that oftentimes a high level of the forming limit curve is accompanied by a high susceptibility to cracking of the sheared edge.

An optimum in the formability of both regions can therefore be achieved only by combining the method according to the invention with the material according to the invention, which has a high level of the forming limit curve.

Chassis components produced according to the invention have the advantage that the present alloy composition of the material has a high tensile strength of up to 1100 MPa.

In addition, the steel advantageously has a particularly high strain hardening, which has a positive effect on the mechanical properties of the ultimately formed chassis component.

In combination with the alloy composition and with the heat-treated microstructure according to the invention, cutting and/or punching edges and sheet-metal edges are produced, which have a particularly high formability capability during the hole expanding test without cracking formation on the sheet-metal edges.

The proposed treatment of sheared edges of plate regions which undergo significant cold deformation during forming into a chassis component results in a marked reduction in crack formation in the manufacturing process.

Tests have shown that it is not necessary to carry out the cutting process at elevated temperature of the cutting edge regions for improvement of the hole expansion capability, but that it is sufficient to heat up only the strain hardened, shear-influenced cutting edge regions for an unexpectedly short time interval in the range of less than 10 seconds, normally between 0.1 and 2.0 seconds, to a temperature of at least 700° C. According to the invention, this can be implemented, detached from the cutting or punching process and the subsequent manufacturing steps, at any time before forming into a component.

The heat application is hereby applied over the entire sheet-metal thickness and in plane direction of the plate in a region which corresponds at most to the sheet-metal thickness. The duration of the heat application depends hereby on the type of the heat treatment process.

Heating itself can take place in any manner, for example, conductively, inductively via radiation heating or by laser treatment. Especially suited for the heat treatment is the conductive heating, as it is frequently applied in the automobile production by the example of spot welding. Advantageously, a spot welding machine is suitable, for example, with rather short impact times for the treatment of punched holes in the plate, whereas for treatment of longer edge portions, the inductive method, radiation heating or laser treatment with longer impact times is to be considered.

In order to protect the heated cutting edge regions against oxidation, an advantageous refinement of the invention provides for a flushing of these regions with inert gases, for example argon. Inert gas flushing takes hereby place during the duration of the heat treatment, but may also, if necessary, be applied in addition shortly before the start and/or within a limited time period also after executing the heat treatment.

Thus, the heat input is implemented only in a very concentrated manner in the shear-influenced cutting edge regions and is therefore associated with comparatively low energy consumption, in particular with regard to processes in which the entire plate is supplied to a heating or by orders of magnitude a more time-consuming stress relief annealing finds application.

The process window for the temperature to be reached in the cutting edge region is also very large and covers a temperature range of 700° C. up to the solidus temperature of approx. 1500° C.

The tests have also shown that the elimination of strain hardening by itself is crucial for a significant improvement in hole expansion capability and the incurable discontinuities, such as, e.g., pores, are of secondary importance. This is independent on whether the heat treatment takes place below or above the transformation temperature Ac1.

When the heat treatment is carried out above Ac1, a transformation in so-called metastable phases is realized after treatment during the course of a rapid cooldown as a result of the surrounding cold material in transformable steels. The resultant microstructure will differ from the initial state in terms of increased strength.

Surprisingly, a microstructure transformation which is normally accompanied by an increase in hardness and strength does not adversely affect the hole expansion capability, regardless of whether a harder and less tough microstructure is adjusted compared to the starting microstructure, so that treatment temperatures of the cutting edges of up to the solidus limit become also possible. In any case, it is crucial that the strain hardening introduced by cutting is substantially eliminated.

In order to achieve the objectives according to the invention, it is insufficient according to the present tests to carry out a heating below 700° C. for a period of a few seconds, since a significant reduction in the dislocations introduced by the mechanical separation process has to occur.

Heating of the cutting edges in accordance with the invention prior to the cold forming of the plate has the advantage over the known measures for reducing the edge crack sensitivity that microstructural changes are made only by the heat treatment of the shear-influenced edge regions and the strength is not reduced as a rule but rather increased. The insensitivity to edge cracks in the sense of a greater hole expansion capability can thus be improved by a factor of 2 to factor 5. In the industrial application of heating the cutting edges of micro-alloyed steels according to the invention for chassis components, the significantly increased formability of the critical shear-influenced sheet-metal edge regions enables a significant reduction of rejects on one hand, and, on the other hand, elimination of previously necessary joining operations, for example, by collaring that can now be implemented when forming e.g. bearing sites.

The method steps according to the invention for the production of chassis components in combination with the ahoy composition and the microstructure of the micro-alloyed steel permits more complex component geometries and thus greater design freedom when using the same materials due to the improved forming capability of the cutting edge regions. In addition, as expected the fatigue strength of the cold-formed component is not reduced but advantageously increased as a result of the adjusting microstructure which possibly in comparison to the initial state is harder but homogeneous.

The heat treatment of the cold-formed cutting edge regions can be carried out completely at any time after the cutting or punching processes and prior to the forming of the plate or as an intermediate step in multi-stage forming operations of the plate for the production of chassis components, so that the process steps cutting or punching of the plate, heat treatment of the cutting edges, and forming the plate are completely decoupled from one another. Thus, the production is much more flexible than is possible according to the prior art in integration of edge modification through heat treatment.

Due to the short duration of treatment compared with known measures, the method can be integrated as an intermediate production step in a series production, which specifies a clocking in the range of 0.1 to 10 seconds. In particular, the production of sheet-metal components in the automotive sector in several successive steps thus represents a predestined field of application.

The transformation of the thus prepared plate can also be advantageously carried out with already existing forming took in the production, since no additional heating facilities, such as, e.g., furnaces, for heating the plate are necessary per se. This allows a further cost-effective manufacture and due to the decoupling of the manufacturing steps a high flexibility in the production process.

According to an advantageous refinement of the invention, the heating of the cutting edges may, depending on the intended production process, if this appears advantageous, also take place however immediately after the mechanical cutting or punching processes or immediately before forming into a component, in a work step that is combined with the respective manufacturing process. For example, the cutting and punching devices may be provided with a downstream heat treatment device or the latter may be directly placed upstream of the forming device for cold forming of the plate.

The plate itself may advantageously be rolled, e.g., flexibly with different thicknesses or joined from cold or hot strip of same or different thickness.

The invention is advantageously applicable to hot or cod rolled steel strips having tensile strengths of 600 MPa to 1100 MPa, which may be provided with a corrosion-inhibiting layer as a metallic and/or organic coating. The metallic coating may be made, for example of zinc or an alloy of zinc or of magnesium or of aluminum and/or silicon.

Suitability of coated steel strips is explained by the possibility to limit the treatment of the edge region to a distance to the edge, which amounts to less than the sheet-metal thickness, since the predominant proportion of the harmful strain hardening is in this region during shear cutting. Thus, at sheet-metal thicknesses of few millimeters thickness, a distance of the region to the edge of a few hundred micrometers may already be sufficient, so that, for example, the effective corrosion protection of a metallic corrosion-inhibiting layer is not or only insignificantly influenced.

The invention claimed is:

1. A method for producing a chassis component from micro-alloyed steel, having improved cold formability of strain-hardened, mechanically separated sheet-metal edges, comprising:

providing a hot strip or a hot strip metal sheet, comprising the following alloy composition in weight-%: C: 0.04 to 0.12, Si: max. 0.7, Mn: 1.4 to 2.2, P: max. 0.02, S: max. 0.002, N: max. 0.03, V: 0.005 to 0.5, Nb: 0.005 to 0.1, Ti: 0.005 to 0.2, with $0.05 \leq V+Nb+Ti \leq 0.4$, and one or more of the elements Cr: max. 0.9, Ni: max. 0.5, Cu: max. 0.5, Mo: max. 0.5, wherein the sum of Cu+Cr+Ni is max. 1, the remainder being iron, and impurities resulting from smelting;

cutting a plate from the hot strip or hot strip metal sheet at room temperature and executing punching or cutting operations to achieve recesses, holes, or openings on the plate at room temperature;

limiting heating to only sheet-metal edge regions of the plate by heating only sheet-metal edge regions of the plate that were strain-hardened by the cutting or punching operations to a temperature of at least 700° C. with a holding time of at most 10 seconds, and subsequent cooling in air, wherein the strain-hardened sheet-metal edge regions are heated inductively, conductively, or by radiation heating; and cold forming the plate in one or more steps to a chassis component at room temperature.

2. The method of claim 1, wherein the holding time is 0.02 to 10 seconds.

3. The method of claim 1, wherein the holding time is 0.1 to 2 seconds.

4. The method of claim 1, wherein the strain-hardened sheet-metal edge regions are heated to a temperature of 700° C. to solidus temperature.

5. The method of claim 1, wherein the strain-hardened sheet-metal edge regions are heated to a temperature of Ac1 to solidus temperature.

6. The method of claim 1, wherein the strain-hardened sheet-metal edge regions are heated inductively or conductively.

7. The method of claim 1, wherein the strain-hardened sheet-metal edge regions are heated by a resistance welding device.

8. The method of claim 1, further comprising applying an organic and/or metallic coating on the plate.

9. The method of claim 8, wherein the metallic coating contains Zn and/or Mg and/or Al and/or Si.

10. The method of claim 1, further comprising protecting a region around a site where the strain-hardened sheet-metal edge regions are heated against oxidation.

11. The method of claim 10, wherein the region which is protected against oxidation is flushed with inert gas, at least during heat application.

12. The method of claim 1, further comprising flushing a region with inert gas around a site where the strain-hardened sheet-metal edge regions are heated before and/or after heat application.

13. The method of claim 1, wherein the heating of the sheet metal edge regions of the plate is limited to a distance to an edge of the plate less than a sheet-metal thickness.

14. A steel chassis component, comprising the following alloy composition in weight-%:

C: 0.04 to 0.12, Si: max. 0.7, Mn: 1.4 to 2.2, P: max. 0.02, S: max. 0.002, N: max. 0.03, V: 0.005 to 0.5, Nb: 0.005 to 0.1, Ti: 0.005 to 0.2, and $0.05 \leq V+Nb+Ti \leq 0.4$ and one or more of the elements Cr: max. 0.9, Ni: max. 0.5, Cu: max. 0.5, Mo: max. 0.5, wherein the sum of Cu+Cr+Ni is max. 1, the remainder being iron, and impurities resulting from smelting, wherein the steel chassis component is produced by cold forming of a plate, wherein the plate is mechanically cut at room temperature before forming from a strip or sheet metal, and optionally executing further punching or cutting operations to achieve recesses or openings at room temperature, wherein before a transformation to the chassis component, only the cut or punched sheet-metal edges, which have undergone strain hardening, are subjected to an inductive, conductive or radiation heat treatment, limited to heating only sheet-metal edge regions of the plate that were strain-hardened by the cutting or punching operations, of at least 700° C. with a holding time of at most 10 seconds and subsequent cooling in air.

15. The steel chassis component of claim 14 for the production of an axle bracket, transverse control arm, multilink rear axle, twist-beam axle, front axle, control arm, longitudinal and transverse cross members.

16. The steel chassis component of claim 14, wherein the heating of the sheet metal edge regions of the plate is limited to a distance to an edge of the plate less than a sheet-metal thickness.

17. The steel chassis component of claim 14, wherein the heating of the sheet metal edge regions of the plate is performed inductively or conductively.

18. A method for the production of a chassis component from micro-alloyed steel, having improved cold formability of strain-hardened, mechanically separated sheet-metal edges, comprising:

providing a hot strip or a hot strip metal sheet, comprising the following alloy composition in weight-%: C: 0.04 to 0.12, Si: max. 0.7, Mn: 1.4 to 2.2, P: max. 0.02, S: max. 0.002, N: max. 0.03, V: 0.005 to 0.5, Nb: 0.005 to 0.1, Ti: 0.005 to 0.2, with $0.05 \leq V+Nb+Ti \leq 0.4$, and one or more of the elements Cr: max. 0.9, Ni: max 0.5, Cu: max. 0.5, Mo: max. 0.5, wherein the sum of Cu+Cr+Ni is max. 1, the remainder being iron, and impurities resulting from smelting;

cutting a plate from the hot strip or hot strip metal sheet at room temperature and executing punching or cutting operations, to achieve recesses, holes or openings on the plate at room temperature;

limiting heating to only sheet-metal edge regions of the plate by heating only sheet-metal edge regions of the plate that were strain-hardened by the cutting or punching operations to a temperature of at least 700° C. with a holding time of at most 10 seconds and subsequent cooling in air, wherein the heat treatment at the sheet-metal edge regions of the plate is applied over an entire sheet-metal thickness and is limited in a plane-direction of the plate to a distance to an edge of the plate, which corresponds at most to the sheet-metal thickness; and cold forming the plate in one or more steps to a chassis component at room temperature.

19. A steel chassis component, comprising the following alloy composition in weight-%: C: 0.04 to 0.12, Si: max. 0.7, Mn: 1.4 to 2.2, P: max. 0.02, S: max, 0.002, N: max. 0.03. V: 0.005 to 0.5, Nb: 0.005 to 0.1, Ti: 0.005 to 0.2, and $0.05 \leq V+Nb+Ti \leq 0.4$ and one or more of the elements Cr: max. 0.9, Ni: max 0.5, Cu: max. 0.5, Mo: max. 0.5, wherein the sum of Cu+Cr+Ni is max. 1, the remainder being iron, and impurities resulting from smelting, wherein the steel chassis component is produced by cold forming of a plate, wherein the plate is mechanically cut at room temperature before forming from a strip or sheet metal, and optionally executing further punching or cutting operations to achieve recesses or openings at room temperature, wherein before a transformation to the chassis component, the cut or punched sheet-metal edges, which have undergone strain hardening, are subjected to a heat treatment of at least 700° C. over a time period of at most 10 seconds, wherein the heat treatment at sheet-metal edge regions of the plate is applied over an entire sheet-metal thickness and is limited in a plane-direction of the plate to a distance to an edge of the plate, which corresponds at most to the sheet-metal thickness.

* * * * *